US008931949B2

(12) United States Patent
Erard

(10) Patent No.: US 8,931,949 B2
(45) Date of Patent: Jan. 13, 2015

(54) EXTERIOR ELEMENT WITH IMPROVED FASTENING

(71) Applicant: Omega SA, Biel/Bienne 4 (CH)

(72) Inventor: Bastien Erard, Les Breuleux (CH)

(73) Assignee: Omega SA, Biel/Bienne (CH)

( * ) Notice: Subject to any disclaimer, the term of this patent is extended or adjusted under 35 U.S.C. 154(b) by 0 days.

(21) Appl. No.: 13/908,249

(22) Filed: Jun. 3, 2013

(65) Prior Publication Data

US 2013/0329537 A1 Dec. 12, 2013

(30) Foreign Application Priority Data

Jun. 6, 2012 (EP) ..... 12171070

(51) Int. Cl.
*G04B 39/00* (2006.01)
*G04B 19/28* (2006.01)
*G04B 37/00* (2006.01)

(52) U.S. Cl.
CPC ..... *G04B 19/283* (2013.01); *G04B 19/28* (2013.01); *G04B 37/0008* (2013.01)
USPC ..... 368/295

(58) Field of Classification Search
CPC .. G04B 19/28; G04B 19/283; G04B 37/0008; G04B 39/002; G04B 47/046
USPC ..... 368/295, 205, 223, 228, 232, 236, 239, 368/243, 286–292, 294, 296, 297, 299, 300, 368/319, 309–310
See application file for complete search history.

(56) References Cited

U.S. PATENT DOCUMENTS 8,547,802 B2 * 10/2013 Hiranuma ..... 368/205
8,556,500 B2 * 10/2013 Hiranuma ..... 368/295
8,619,506 B2 * 12/2013 Hiranuma ..... 368/205
2008/0068935 A1 3/2008 Hiranuma et al.

FOREIGN PATENT DOCUMENTS

FR 2 173 897 10/1973

OTHER PUBLICATIONS

European Search Report issued Nov. 27, 2012, in European Patent Application No. 12171070.1, filed Jun. 6, 2012.

* cited by examiner

*Primary Examiner* — Edwin A. Leon
(74) *Attorney, Agent, or Firm* — Oblon, Spivak, McClelland, Maier & Neustadt, L.L.P.

(57) ABSTRACT

A middle part of a timepiece case includes an exterior element secured to the middle part on a securing area by an elastic securing structure. The middle part includes an aperture opening onto the securing area at the securing structure allowing a user to act on and deform the securing structure and to separate the exterior element from the middle part. The securing structure includes a male part including two hooks, one of which is flexible, arranged on one of faces of the exterior element and a female part arranged on the middle part including a groove. The male part cooperates elastically with the female part so that the two hooks are inserted into the groove to secure the exterior element to the middle part. The aperture opens into the female part, allowing the user to act on the flexible hook to separate the exterior element from the middle part.

19 Claims, 5 Drawing Sheets

EXTERIOR ELEMENT WITH IMPROVED FASTENING

This application claims priority from European Patent Application No. 12171070.1 filed Jun. 6, 2012, the entire disclosure of which is incorporated herein by reference.

The present invention concerns a timepiece comprising a middle part closed by a back cover and a crystal, said timepiece further comprising a rotating bezel system secured to said middle part.

The technical field of the invention is the technical field of fine mechanics.

BACKGROUND OF THE INVENTION

The present invention concerns an exterior element for the middle part of a timepiece case such as a timepiece bezel.

Exterior elements such as known rotating bezel systems 2, seen in FIG. 1, comprise a rotating bezel 4 taking the form of an annular part. This annular part has a top face and a bottom face, the top face being the face seen by the user. As seen in FIG. 2, this bezel 8 has a toothing 10 in the bottom surface thereof. The rotating bezel system further includes a spring means 11. This spring means 11 is inserted between the rotating bezel and the middle part 3 of timepiece 1, when bezel 4 is forcibly fitted onto the middle part of the timepiece. This spring means 11 takes the form of a flat ring comprising leaves on the surface thereof facing the toothing in bezel 8. These leaves are arranged to tilt relative to the plane of the flat ring. The leaves have some elasticity so that the spring means acts on the rotating bezel to exert a vertical force. This vertical force has a tendency to push the bezel off the middle part of the timepiece.

The leaves also serve to cooperate with the toothing in the bezel. The leaves and toothing are then configured so that the bezel can only rotate in one direction, since the leaves prevent the bezel from rotating if the user attempts to rotate said bezel in the wrong direction. Generally, the bezel and the spring means are made of steel which has the advantage of being durable and inexpensive.

The bezel is driven onto the middle part 2 of the watch case. To achieve this, the middle part has a peripheral shoulder 2*a* in which said rotating bezel system is placed. The shoulder 2*a* has a wall 2*b* parallel to the central axis (C) of the middle part and a wall perpendicular to the central axis of the middle part. Parallel wall 2*b* of said shoulder has a peripheral groove 2*c*. Bezel 8 is an annular part having a peripheral rim 8*a* on the bottom face thereof. The rim is provided with a continuous addendum 12 extending along said rim towards the axial centre of the bezel. When said rotating bezel system is driven onto the middle part of the watch case, the continuous addendum is inserted into the peripheral groove of the shoulder ensuring that the bezel is held vertically on the middle part.

One drawback of this system is that it cannot be disassembled. Indeed, the bezel of prior art rotating bezel systems is driven onto the middle part of the case so that any attempt to remove the rotating bezel system generally has to be achieved by pulling the system off, which results in its destruction.

Naturally, this depends on the material of which the bezel is made. A plastic bezel which is driven onto the middle part will be easier to remove than a steel bezel. This tendency arises from the fact that plastic has elastic properties meaning that it deforms more easily than steel, which means that it is easier to assemble and disassemble a plastic bezel than a steel bezel.

SUMMARY OF THE INVENTION

It is an object of the invention to overcome the drawbacks of the prior art by proposing to provide a middle part including at least one exterior element which is easy to assemble and disassemble.

The invention therefore concerns a middle part of a timepiece case comprising at least one exterior element, said exterior element being secured to the middle part on a securing area by an elastic securing means, characterized in that said middle part further includes at least one aperture opening onto the securing area at said elastic securing means allowing the user to act on and deform said elastic securing means and to separate the exterior element from said middle part, said securing means comprising a male part which includes at least two hooks, at least one of which is flexible, arranged on one of the faces of said exterior element and a female part arranged on said middle part comprising at least one groove, the male part cooperating elastically with the female part so that the at least two hooks are inserted into the said at least one groove in order to secure said exterior element to said middle part and in that said at least one aperture opens into the female part, allowing the user to act on said at least one flexible hook to separate the exterior element from said middle part.

A first advantage of this invention is that it provides a middle part comprising at least one exterior element which can easily be separated from said middle part. This means that it is possible to have an exterior element which can easily be changed in the event of a shock or damage or which can easily be removed to facilitate maintenance.

In a second embodiment, the middle part includes a horizontal wall perpendicular to a central axis of the middle part on which the female part is arranged, the exterior element being arranged on said horizontal wall via the face of said exterior element on which a male part is arranged.

In a third embodiment, the middle part includes a shoulder formed by said horizontal wall and by a vertical wall parallel to the central axis of the middle part, the exterior element being mounted on said shoulder.

In a fifth embodiment, each of said hooks includes a strip extending perpendicularly from the face of the exterior element on which the male part is arranged, the free end of said strip having a horizontal protrusion extending perpendicularly to said strip.

In a sixth embodiment, said male part includes several strips arranged along a circle, and at least two of said strips include a protrusion, said female part comprising at least one groove into which the strips are inserted.

In another embodiment, said male part includes a first strip and a second strip having a protrusion, the first strip and the second strip being diametrically opposite each other and arranged so that the first strip extends angularly at a first angle and the second strip extends angularly at a second angle, the first angle being smaller than the second angle and so that action on the first strip separates the exterior element from said middle part.

In another embodiment, the middle part includes a shoulder, formed of a vertical wall parallel to the central axis of the middle part and of a horizontal wall, perpendicular to the central axis of the middle part, on which the female part is arranged, in which the exterior element is arranged.

In another embodiment, said female part includes a rim extending from the horizontal wall of the middle part in a parallel direction to the central axis of the middle part, the free end of said rim comprising a first protruding portion extending parallel to said horizontal wall towards the central axis of the middle part, said first protruding portion defining a space forming the groove into which said at least one aperture opens.

In another embodiment, said female part comprises a recess forming the groove, said recess has an inner flank and an outer flank perpendicular to the horizontal wall of the middle part, said outer flank having a second protruding portion extending parallel to said horizontal wall towards the central axis of the middle part, said first protruding portion defining a space into which said male part is inserted, said at least one aperture opening into said space.

In another embodiment, the first angle extends over around 20°, and the second angle extends over around 120°.

In another embodiment, the middle part comprises two apertures allowing the user to act more efficiently on said male part to separate the exterior element from the middle part.

This invention also concerns a timepiece case comprising a middle part, said middle part being closed by a crystal and a back cover, said case further comprising a bezel system, characterized in that said middle part is the middle part according to the invention.

In an advantageous embodiment, the exterior element of the middle part is said bezel system.

In another advantageous embodiment, the exterior element of the middle part is the back cover.

In another advantageous embodiment, the bezel system is a bezel comprising the male part of the securing means.

In another advantageous embodiment, the bezel system includes a pre-assembly ring secured to a bezel ring, the pre-assembly ring comprising the male part of the securing means, the bezel system further comprising a spring means and notch means.

The present invention also concerns a timepiece including the case of the invention.

BRIEF DESCRIPTION OF THE DRAWINGS

The objects, advantages and features of the middle part according to the present invention will appear more clearly in the following detailed description of at least one embodiment of the invention, given solely by way of non-limiting example and illustrated by the annexed drawings, in which.

DETAILED DESCRIPTION OF THE INVENTION

The present invention proceeds from the general inventive idea which consists in providing an exterior element for the middle part of a timepiece which is easy to disassemble.

Figure 12:
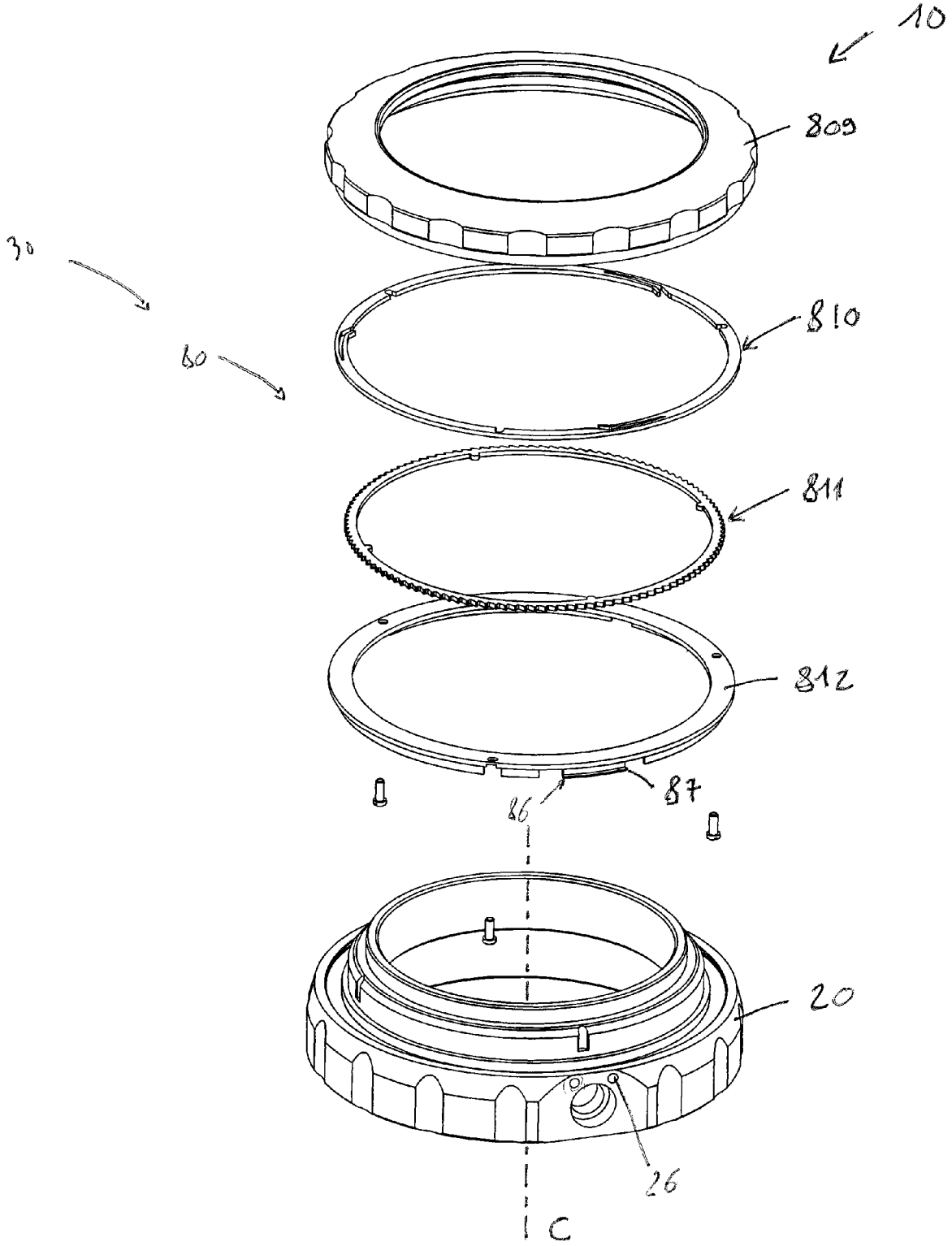
FIG. 12 is a schematic, exploded view of the bezel system according to the invention.

A timepiece case 10 comprises a middle part 20 closed by a back cover 60 and by a crystal 40. This case 10 further comprises the exterior element 30. This exterior element 30 is secured to a securing area of the middle part. This exterior element 30 may be a bezel system 80 secured to the middle part. This bezel system 80 takes the form of an annular ring having a top face and a bottom face. Middle part 20 comprises a shoulder 2*a* in which the bezel is placed. This shoulder 2*a* has a vertical wall 21, i.e. parallel to the central axis (C) of the middle part 20, and a horizontal wall 22, i.e. perpendicular to the central axis (C) of middle part 20. The top face of the annular part is the face seen by the user; the bottom face is the face opposite horizontal wall 22 of the middle part. An exploded view of case 10 is shown in FIG. 12.

Figure 1:
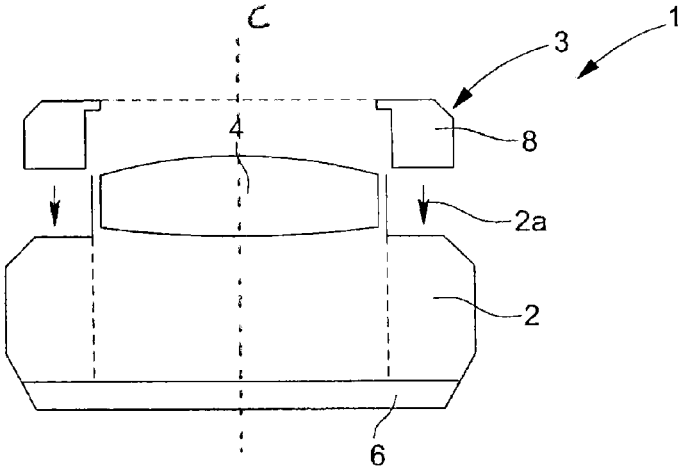
Fig. 1 Background Art
FIG. 1 is a cross-section of a timepiece provided with a bezel system.
Figure 2:
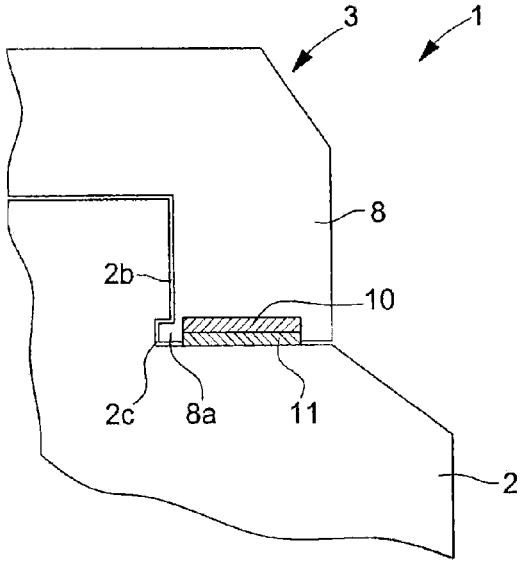
Fig. 2 Background Art
FIG. 2 is a schematic view of a bezel system of the prior art.
Figure 3:
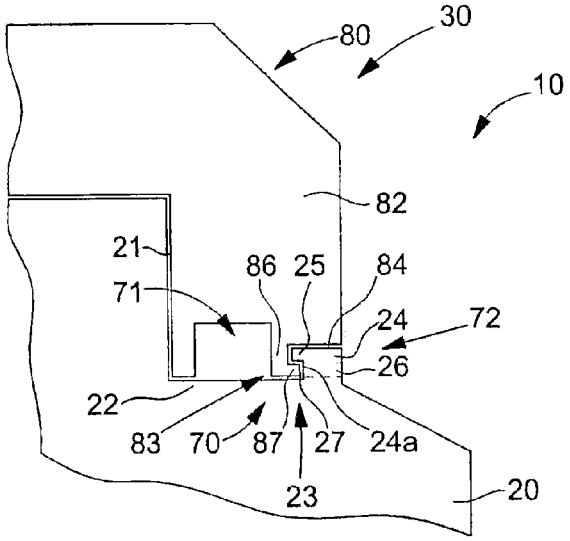
FIGS. 3 to 4 are schematic views of two alternatives of the first embodiment of the bezel system of the invention.

Advantageously, the bezel system 80 seen in FIG. 3 is a bezel 82 secured to middle part 20 so as to be easily removable therefrom. To achieve this, a securing means 70 is arranged on middle part 20 and on exterior element 30, here bezel 82, so that it is possible and simple to disassemble said bezel system 80.

Securing means 70 includes a male part 71 arranged on bezel 80 and a female part 72 arranged on middle part 20. Male part 71 is arranged on bezel 82 preferably on bottom face 84. This male part 71 takes the form of at least two hooks 83 extending from said bottom face 84, i.e. perpendicularly to the plane of bottom face 84. Hooks 83 are formed of a strip 86, which extends in a vertical direction, perpendicular to the plane of bottom face 84 and the free end of which comprises a protrusion 87. This protrusion 87 extends in a horizontal direction, i.e. parallel to the plane of bottom face 84 or perpendicular to the strip, outwards. This means that protrusion 87 extends in a direction tending to move away from the central axis of the annular part which is bezel 82.

Female part 72 is arranged on middle part 20 and, in this first embodiment, takes the form of grooves 23, 203 in which a hook 83 of bezel 82 is inserted. The number of grooves 23, 203 is at least equal to the number of hooks 83 arranged on bezel 82. This groove 23, 203 is arranged so that, when hook 83 is totally engaged therein, protrusion 87 of said hook 83 prevents the bezel from being separated from middle part 20. It is clear that at least two hooks 83 are necessary to secure bezel 82.

In a first alternative of female part 70 of middle part 20 seen in FIG. 3, the hook takes the form of a rim 24 located on horizontal wall 22 of the shoulder. This rim 24 extends perpendicularly to horizontal wall 22 of the shoulder and is peripheral. This peripheral rim 24 has an inner face and an outer face 24*a*. The outer face, the farthest from the central axis (C) of middle part 20 includes, at the free end of rim 24, a protruding portion 25 parallel to horizontal wall 22. This protruding portion 25 forms an open space 27 between said protruding portion 25 and horizontal wall 22 of shoulder 2*a*. This space is used for inserting protrusion 87 of hook 83 therein.

Figure 4:
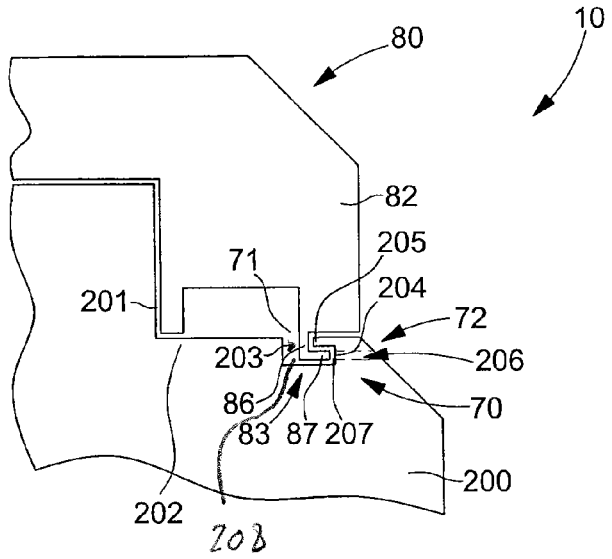

In a second alternative of female part 70 of middle part 200 seen in FIG. 4, female part 70 includes a recess 203*a* forming a groove 203 located on the horizontal wall 202 of shoulder 2*a*. This groove 203 has an inner flank and an outer flank 204. A protruding portion 205 extends from outer flank 204, the farthest from central axis (C) of middle part 20, forming an open space 207 between said protruding portion 205 and horizontal wall 202 of shoulder 2*a*. This space 207 is used for inserting protrusion 87 of hook 83 therein when hook 83 is inserted into groove 203.

During assembly, bezel 82 is placed in the shoulder so that each hook 83 is placed opposite a groove 23, 203. When pressure is exerted on bezel 82 to secure it to bezel 20, 200, hooks 83 tend to be elastically deformed to enter grooves 23, 203. When protrusion 87 of each hook 83 is opposite space 27, 207 between said protruding portion 25, 205 and horizontal wall 22, 202 of the shoulder, hooks 83 return to their rest position and the protrusion 87 of each hook 83 enters said space 27, 207. The cooperation between hooks 83 and the space between said protruding portion 25, 205 and horizontal wall 22, 202 provides axial retention. Protrusion 87 provides a locking surface which abuts on protruding portion 25, 205 and locks bezel 82 if the user pulls on said bezel. Thus, for two hooks 83 located on the bezel, middle part 20, 200 includes two grooves 23, 203, said hooks 83 and grooves 23, 203 being arranged such that bezel 82 is correctly positioned, i.e the screen printed time indications on the bezel are properly positioned relative to the dial.

Figure 10:
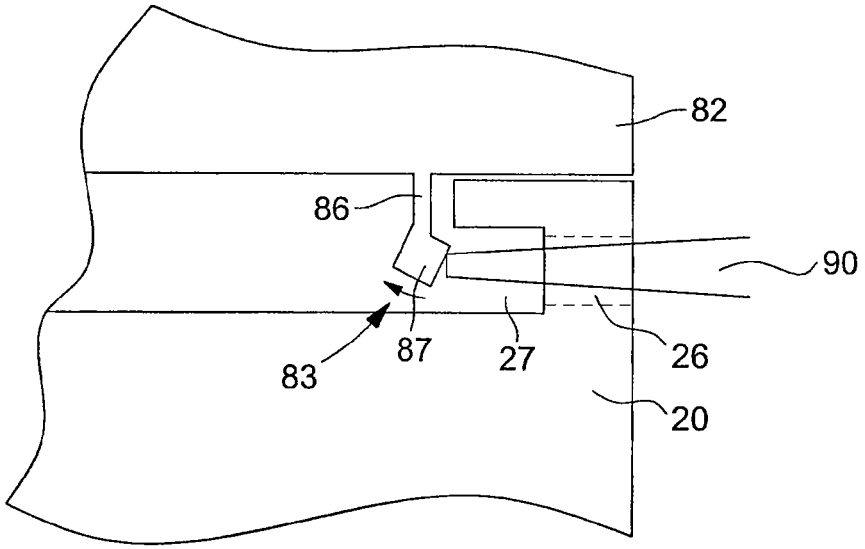
Figure 11:
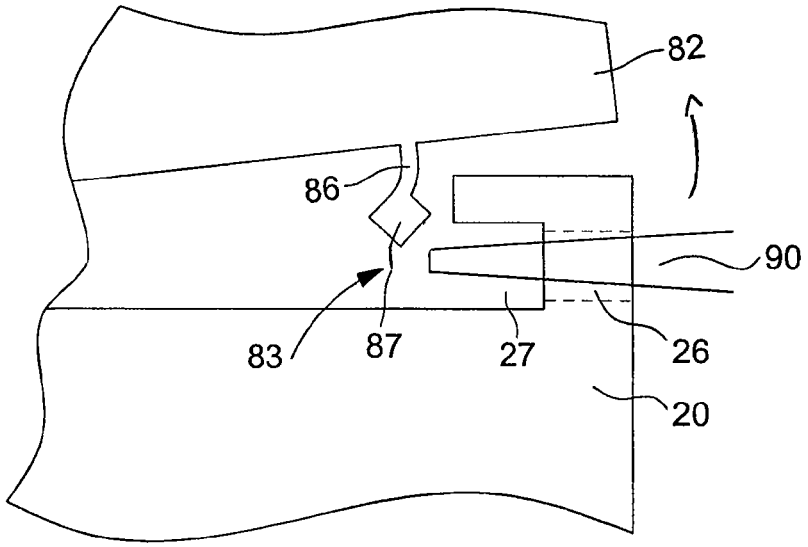

Cleverly, according to the invention, exterior element 30, i.e. bezel 82, can easily be disassembled. To achieve this, middle part 20, 200 comprises at least one aperture 26, 206 opening onto the securing area, i.e. on the female part. It is clear that said at least one aperture 26 206 opens into space 27, 207 present between said protruding portion 25, 205 and the horizontal wall 22, 202 of the shoulder. This aperture 26, 206 is dimensioned so that the user can slide a tool 90 therein which may be a blade or a tip as seen in FIGS. 8 to 11. Tool 90 is inserted into said aperture 26, 206 so as to create pressure on protrusion 87 which holds said bezel 82 secured to middle part 20, 200, as seen in FIGS. 8 to 11. Thus, when the user slides tool 90 into aperture 26, 206 until it comes into contact with said protrusion 87, he exerts pressure on protrusion 87 via tool 90 so that hook 83 is deformed and protrusion 87 of said hook leaves space 27, 207 between said protrusion 25, 205 and horizontal wall 22, 202 of the shoulder as seen in FIG. 10. It then becomes possible for the user to raise the bezel to remove one of hooks 83 from groove 23, 203, as seen in FIG. 11. The user can then manipulate bezel 83 to release the other hook 83 from groove 23, 203 with which it cooperates.

Preferably, middle part 20, 200 comprises two apertures 26, 206 arranged so that a tool 90 with two tips can be used. Indeed, if hook 83 has a large width, exerting force at only one point means there is a risk of said hook 83 only being deformed at the place where pressure is exerted. The force exerted is thus liable to be insufficient to cause protrusion 87 to be released from space 27, 207 between said protrusion 25, 205 and horizontal wall 22, 202 of the shoulder. Having a part configured with two tips means that the forces exerted by the tool are better distributed on protrusion 87 and therefore hook 83. This means that there are two contact points with protrusion 87 and thus said hook 83 is elastically deformed more efficiently.

Figure 5:
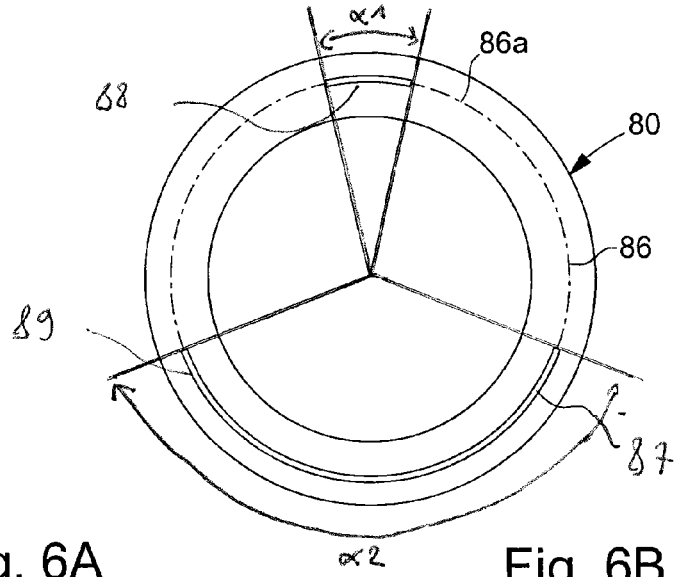
FIG. 5 is a schematic, bottom view of a preferred variant of the first embodiment of the bezel system of the invention.

In a first variant of this first embodiment, the male part 71 of securing means 70 includes several strips 86 arranged in a virtual circle 86*a* as seen in FIG. 5. Male part 71 is arranged so that some strips 86 have a protrusion 87 extending in a direction which tends to move away from the centre of virtual circle 86*a*. Female part 72 located on middle part 20, 200 takes the form of a groove 23, 203 forming a circle identical to virtual circle 86*a*. This groove 23, 203 may be arranged to follow the principle of the first version or of the second version of the hooking system. Male part 71 of bezel 82 may then cooperate with female part 72 of middle part 20, 200. This configuration also simplifies assembly since bezel 82 can be assembled without any specific orientation with respect to middle part 20, 200. The advantage of this configuration is that it allows bezel 82 to rotate with respect to the middle part, with the male part moving along the groove which acts like a rail here. Toothing means and spring means are thus arranged on the middle part for controlling the rotation of the bezel.

Another advantage is that the male part may also have strips 86 which do not have a protrusion 87. These strips 86 are used for radial retention.

Advantageously, this variant, seen in FIG. 5, is configured so that male part 71 comprises two strips 86 having a protrusion 87. Strips 86 are preferably diametrically opposite each other; a first strip 88 extends angularly at a first angle al of around 20°, whereas the second strip 89 extends at an angle $\alpha 2$, greater than the first angle, of around 120°. This particular configuration provides improved axial retention. In fact, the axial retention of bezel 82 on middle part 20, 200 is achieved by the protrusions 87 of hooks 83 which cooperate with groove 23, 203, as explained above. If both strips 86 extended angularly over a small angle, axial retention would be provided but there would be a risk that strong traction on bezel 82 could remove it from middle part 20 and 200 and damage said bezel. Indeed, the traction force would be applied over a small surface area causing high stress on strips 86 with protrusion 87 and thus a significant risk of breakage. With the proposed configuration, axial retention is improved since male part 71 has a larger locking surface. Consequently, the stress exerted during traction is distributed over a larger surface area and less stress is applied to protrusions 87.

Moreover, this configuration is achieved such that first strip 86, which extends angularly over a small angle is the strip operated by the user to release bezel 82 from middle part 20, 200. Indeed, when the user wishes to release bezel 82 from middle part 20, 200, he acts on bezel 82 so that first strip 86 moves opposite the at least one aperture 26, 206 opening into space 27, 207 between said protruding portion 25, 205 and horizontal wall 22, 202 of the shoulder. This allows the user to use his tool 90 to act on first strip 86 and thus to release bezel 82 from middle part 20, 200. The fact that there are two strips 86 with a protrusion 87 disposed diametrically opposite each other and that one of the strips extends over a larger angle than the other provides a bezel 82 which is properly retained on middle part 20, 200, yet which can easily be separated therefrom. However, the strip which extends over a larger angle must not exceed a certain angle.

Figure 6A:
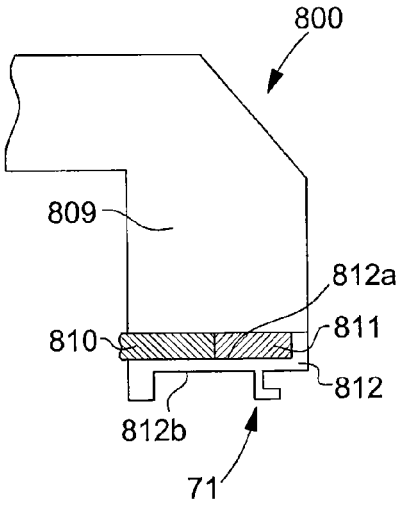
FIGS. 6A and 6B are schematic views of a second variant of the first embodiment of the bezel system of the invention.
Figure 6B:
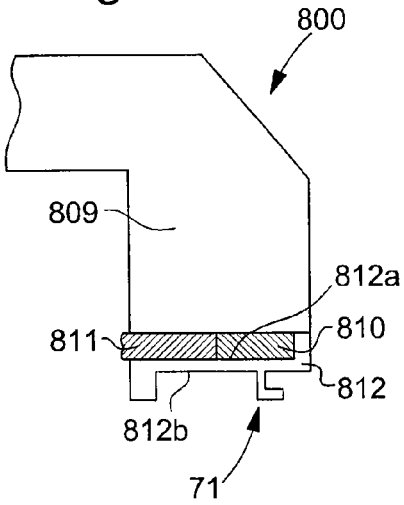

In a second variant of this first embodiment bezel system 800, seen in FIGS. 6*a* and 6*b*, is formed of several elements. It is thus clear that bezel system 800 comprises a pre-assembly ring 812 having a bottom face 812*b* and a top face 812*a*. Spring means 810, toothing means 811 and a bezel ring 809 are arranged on the top face 812*a* of pre-assembly ring 812. Bezel ring 809 is the part seen by the user. Spring means 810 and toothing means 811 are arranged so that spring means 810 is angularly integral with middle part 20, 200, toothing means 811 being angularly integral with pre-assembly ring 812 and bezel ring 809. Spring means 810 may be angularly integral with pre-assembly ring 812 and with bezel ring 809, with toothing means 811 being angularly integral with middle part 20, 200. Male part 71 of securing means 70 is arranged on top face 812*b* of pre-assembly ring 812. This variant has the advantage of providing a bezel system 800 in the form of an independent module which can be fixed to middle part 20, 200 or separated from middle part 20, 200 as a single unit.

Figure 7:
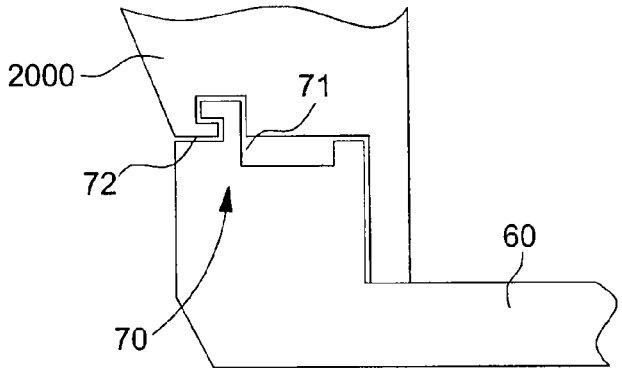
FIG. 7 is a schematic view of a second embodiment of the bezel system of the invention.
Figure 8:
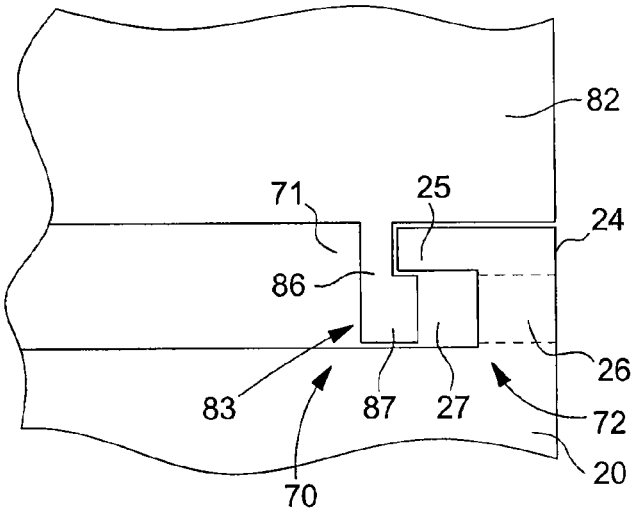
FIGS. 8 to 11 show schematic views of the steps for separating the bezel from the middle part according to the invention.
Figure 9:
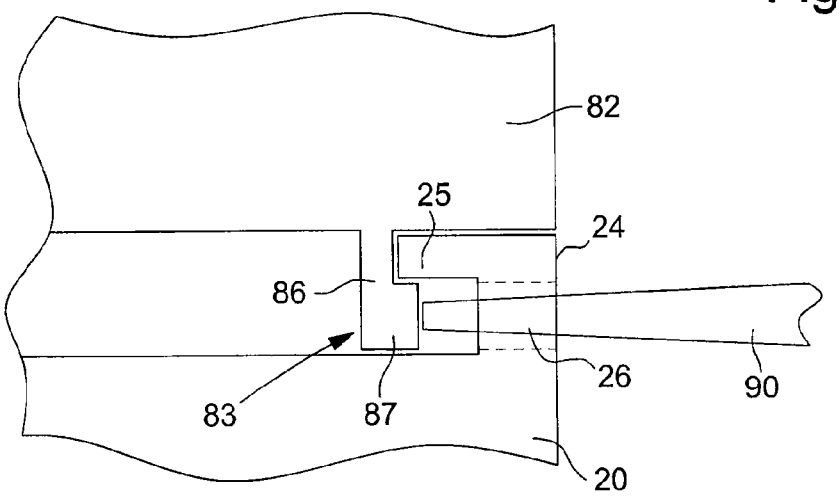

In a second embodiment visible in FIG. 7, exterior element 30 is the back cover 60 secured to middle part 2000. Indeed, it may be useful to have a removable back cover 60 both in a mechanical timepiece and an electronic timepiece. This possibility of having a removable back cover 60 provides easy access to the watch movement. It is therefore easy to maintain the movement, replace parts or change the battery.

Middle part 2000 comprises a bottom face to which said back cover 60 is secured. Preferably, middle part 2000 and back cover 60 have a substantially similar shape for aesthetic reasons. The bottom face of middle part 2000 includes the female part 72 of securing means 70 for cooperating with male part 71, arranged on back cover 60.

The bottom face of the middle part could also have a similar shoulder to that described for the first embodiment. The exterior element takes the form here of a cover which closes the middle part. The features of the first embodiment and the variants and versions thereof may be applied to this second embodiment.

The sealing of this exterior element arranged as the back cover of the middle part may be improved by inserting a sealing gasket in said exterior element.

It will be clear that various alterations and/or improvements and/or combinations evident to those skilled in the art may be made to the various embodiments of the invention set out above without departing from the scope of the invention defined by the annexed claims.

What is claimed is:

1. A middle part of a timepiece case comprising at least one exterior element, said exterior element being secured to the middle part on a securing area by an elastic securing structure, wherein said middle part further includes at least one aperture opening onto the securing area at said elastic securing structure allowing a user to act on and deform said elastic securing structure and to separate the exterior element from said middle part, said elastic securing structure comprising a male part which includes at least two hooks, at least one of which is flexible, arranged on one of faces of said exterior element and a female part arranged on said middle part comprising at least one groove, the male part cooperating elastically with the female part so that the at least two hooks are inserted into the at least one groove in order to secure said exterior element to said middle part, and wherein said at least one aperture opens into the female part, allowing the user to act on said at least one flexible hook to separate the exterior element from said middle part.

2. The middle part according to claim 1, wherein the middle part comprises a horizontal wall perpendicular to a central axis of the middle part on which the female part is arranged, the exterior element being arranged on said horizontal wall via the face of said exterior element on which a male part is arranged.

3. The middle part according to claim 2, wherein the middle part includes a shoulder formed of said horizontal wall and of a vertical wall parallel to the central axis of the middle part, the exterior element being mounted on said shoulder.

4. The middle part according to claim 1, wherein each of said hooks comprises a strip extending perpendicularly from the face of the exterior element on which the male part is arranged, the free end of said strip having a horizontal protrusion extending perpendicularly to said strip.

5. The middle part according to claim 4, wherein said male part includes several strips arranged along a circle, and wherein at least two of said strips comprise a protrusion, said female part comprising at least one groove into which the strips are inserted.

6. The middle part according to claim 4, wherein said male part includes a first strip and a second strip having a protrusion, the first strip and the second strip being diametrically opposite each other and arranged so that the first strip extends angularly at a first angle and the second strip extends angularly at a second angle, the first angle being smaller than the second angle and wherein action on the first strip separates the exterior element from said middle part.

7. The middle part according to claim 2, wherein said female part comprises a rim extending from the horizontal wall of the middle part in a direction parallel to the central axis of the middle part, the free end of said rim comprising a first protruding portion extending parallel to said horizontal wall towards the central axis of the middle part, said first protruding portion defining a space forming the groove into which the at least one aperture opens.

8. The middle part according to claim 2, wherein said female part comprises a recess forming the groove, said recess having an inner flank and an outer flank perpendicular to the horizontal wall of the middle part, said outer flank having a second protruding portion extending parallel to said horizontal wall towards the central axis of the middle part, said first protruding portion defining a space into which said male part is inserted, said at least one aperture opening into said space.

9. The middle part according to claim 6, wherein the first angle extends over around 20° and the second angle extends over around 120°.

10. The middle part according to claim 1, wherein the middle part includes two apertures allowing the user to act more efficiently on said male part to separate the exterior element from the middle part.

11. The timepiece case comprising a middle part, said middle part being closed by a crystal and a back cover, said case further comprising a bezel system, wherein said middle part is the middle part according to claim 1.

12. The timepiece case according to claim 11, wherein the exterior element of the middle part is said bezel system.

13. The timepiece case according to claim 11, wherein the exterior element of the middle part is the back cover.

14. The timepiece case according to claim 12, wherein the exterior element of the middle part is the back cover.

15. The timepiece case according to claim 11, wherein the bezel system comprises a bezel including the male part of the elastic securing structure.

16. The timepiece case according to claim 12, wherein the bezel system comprises a bezel including the male part of the elastic securing structure.

17. The timepiece case according to claim 11, wherein the bezel system includes a pre-assembly ring secured to a bezel ring, the pre-assembly ring comprising the male part of the elastic securing structure, the bezel system further comprising a spring and a notch.

18. The timepiece case according to claim 12, wherein the bezel system includes a pre-assembly ring secured to a bezel ring, the pre-assembly ring comprising the male part of the elastic securing structure, the bezel system further comprising a spring and a notch.

19. The timepiece including the case according to claim 11.

* * * * *